US006168686B1

(12) United States Patent
Sutman et al.

(10) Patent No.: US 6,168,686 B1
(45) Date of Patent: Jan. 2, 2001

(54) PAPERMAKING AID

(75) Inventors: Frank J. Sutman, Jacksonville; Richard A. Hobirk, Fernandina Beach, both of FL (US)

(73) Assignee: Betzdearborn, Inc., Trevose, PA (US)

( * ) Notice: Under 35 U.S.C. 154(b), the term of this patent shall be extended for 0 days.

(21) Appl. No.: 09/152,695

(22) Filed: Aug. 19, 1998

(51) Int. Cl.[7] ..... D21H 11/08; D21H 21/10

(52) U.S. Cl. ..... 162/142; 162/150; 162/158; 162/164.1; 162/164.3; 162/164.6; 162/168.2; 162/168.3; 162/175; 162/181.2; 162/181.4; 162/181.5; 162/183

(58) Field of Search ..... 162/175, 168.2, 162/168.3, 164.3, 164.6, 164.1, 181.2, 181.4, 181.5, 158, 142, 150, 183

(56) References Cited

U.S. PATENT DOCUMENTS

| | | | |
|---|---|---|---|
| 4,066,495 | 1/1978 | Voigt et al. | 162/168 NA |
| 4,305,781 | 12/1981 | Langley et al. | 162/164 R |
| 4,613,407 | 9/1986 | Huchette et al. | 162/175 |
| 4,643,801 | 2/1987 | Johnson | 162/164.1 |
| 4,795,531 | 1/1989 | Sofia et al. | 162/164.6 |
| 4,908,100 | 3/1990 | Hunter et al. | 162/175 |
| 5,032,227 | 7/1991 | Derrick et al. | 162/168.1 |
| 5,167,766 | 12/1992 | Honig et al. | 162/168.3 |
| 5,185,062 | 2/1993 | Begala | 162/183 |
| 5,221,435 | 6/1993 | Smith | 162/175 |
| 5,266,164 | 11/1993 | Novak et al. | 162/168.2 |
| 5,431,783 | 7/1995 | Honig | 162/168.3 |
| 5,584,966 | 12/1996 | Moffet | 162/168.1 |
| 5,595,630 | 1/1997 | Moffet | 162/164.1 |

FOREIGN PATENT DOCUMENTS

| | | |
|---|---|---|
| 40028/85 | 3/1985 | (AU) . |
| 63012792 | 1/1980 | (JP) . |
| 2014096 | 1/1990 | (JP) . |
| WO 95/02088 | 1/1995 | (WO) . |

OTHER PUBLICATIONS

Application of Polymeric Flocculant in Newsprint Stock Systems for Fines Retention Improvement; C.H. Tay; Tappi; vol. 63, No. 6; Jun. 1980.

Retention Aids for Quality Improvements in Newsprint; D.S. Honig; 1988 Papermakers Conference; pp. 219–221.

A Survey of Potential Retention Aids for Newsprint Manufacture; R.H. Pelton et al.; Pulp & Paper Canada; vol. 81, No. 1; Jan. 1980.

*Primary Examiner*—Peter Chin
(74) *Attorney, Agent, or Firm*—Woodcock Washburn Kurtz Mackiewicz & Norris LLP

(57) ABSTRACT

A novel method of improving drainage rate and retention of fines which is effective in unfilled, newsprint-type furnish without a silica/bentonite-type particle is disclosed. The method comprises adding a cationic or amphoteric starch, and a cationic polyelectrolyte followed by the addition of a high molecular weight anionic polyacrylamide copolymer.

7 Claims, No Drawings

PAPERMAKING AID

FIELD OF THE INVENTION

The present invention relates to the production of paper or paperboard, and more particularly, to a method for improving the retention and/or drainage properties of mechanical pulp-based furnish in the formation of newsprint, directory stock, ground wood specialty stock.

BACKGROUND OF THE INVENTION

Paper production involves the formation and dewatering of a web of cellulose fibers and optional fillers, and is generally performed in the presence of additives which can improve the end product or the papermaking operation. Many grades of paper include substantial levels of inorganic fillers such as kaolinite, calcium carbonate and titanium dioxide. For example, good quality paper, often referred to as fine paper, may be made from high grade, bleached chemical pulp, and may contain 5 to 35%, by weight of dry paper, of inorganic fillers. In the production of such paper, it is common to use retention aids and drainage aids. Such retention and drainage aids have proven to be cost effective in the production of filled or fine paper for some time.

There is, however, a very large scale production of paper that is substantially unfilled. For instance, the production of newsprint. The unfilled paper is substantially free of filler, and often there is no deliberate addition of filler to the pulp from which the paper is made. Over the past few years, the use of retention aids in the production of newsprint and other mechanical pulp containing grades of paper has become increasingly common. The most common treatments are cationic polyacrylamides, poly(ethylene oxides), and poly (ethyleneimines).

U.S. Pat. No. 4,305,781 discloses a process for enhancing drainage and retention of substantially unfilled paper which comprises including in the suspension a combination of a water soluble, high molecular weight substantially nonionic polymer and a bentonite-type clay.

The effectiveness of a nonionic poly(ethyleneoxide) of high molecular weight for fines retention in newsprint stock was disclosed in "Application of Polymeric Flocculant in Newsprint Stock Systems for Fines Retention Improvement", C. H. Tay, Tappi, Volume 63, No. 6, June 1980. This article also notes that anionic retention aids tend to impair stock drainage characteristics.

In "Retention Aids for Quality Improvements in Newsprint", D. S. Honig, 1988 Paper Makers Conference at 219, it is stated that based upon a large number of research articles on retention aids for newsprint, the overall conclusions have been that conventional polyacrylamides (as single or multiple component systems) are ineffective or uneconomical. This paper goes on to discuss the use of cationic polyacrylamides as well as a dual component low molecular weight cationic polymer/low pKa anionic polyacrylamide treatment as a retention aid in newsprint production. The author concludes that cationic polyacrylamides are less complex, equal or more effective, and in particular, effective at lower dose level than the alternative treatment.

In treatments shown to enhance drainage and fines retention which employ anionic polyacrylamides, a silicate (such as colloidal silica or polysilicate microgel) or bentonite is a required component. See for example, U.S. Pat. Nos. 4,643,801; 5,584,966 and 5,595,630.

SUMMARY OF THE INVENTION

The present inventors have discovered a novel drainage and retention aid treatment which is effective in newsprint-type furnish without a silicalbentonite-type particle. The novel drainage and retention aid treatment of the present invention comprises the sequential or concurrent addition of (i) a cationic or amphoteric starch and (ii) a cationic polyelectrolyte followed by the addition of a high molecular weight anionic polyacrylamide.

DETAILED DESCRIPTION OF THE INVENTION

The present invention relates to a process for the manufacture of paper which provides rapid water drainage and good retention of fines during the forming and dewatering of a paper furnish. The present invention relates to improved water drainage and retention of fines in the formation of paper from a mechanical pulp containing furnish which is substantially unfilled. This refers to papers such as newsprint, directory, and ground wood specialty. Unfilled paper is substantially free of filler, generally containing less than 5%, by weight of dry paper, of filler, and often there is no deliberate addition of filler to the pulp from which the paper or board is made. The paper often contains recycled fiber as a furnish component which may incorporate small (<5%) levels of fillers in the finished sheet.

The present invention relates to an additive combination for unfilled paper processing which enhances water drainage and retention of fines. The additive combination of the present invention is substantially free of microparticle treatment materials such as silica, polysilicate, polysilicate microgels, and clays such as bentonite. The term "substantially free" as used herein means that while a trace amount of such materials may be present, they are not intentionally added to and are not necessary to achieve the efficacy of the treatment combination of the present invention.

The treatment combination of the present invention comprises: an anionic, high molecular weight polyacrylamide; a cationic or amphoteric starch and an organic or inorganic cationic polyelectrolyte. The treatment combination of the present invention is added to an unfilled pulp furnish in a dosage (on an active product basis) of from about 2.5 to 20 lbs. per ton of starch, about 0.25 to 1 lbs. per ton of cationic organic polyelectrolyte, or about 5 lbs. per ton inorganic cationic polyelectrolyte, and a 0.25 to 0.75 lbs. per ton of high molecular weight anionic polyacrylamide. In use of the treatment combination, the order of addition between the starch and the cationic polyelectrolyte is interchangeable, although it is preferred to add the starch first. Both the starch and the cationic polyelectrolyte must be added prior to addition of the anionic polyacrylamide.

The starch component of the treatment combination of the present invention may be dent corn, waxy maize, or potato-based and either cationic or amphoteric in nature. The degree of quaternary ammonium substitution on the starch is preferably between about 0.1 and 0.4%, with about 0.3 to 0.4% most preferred.

The cationic polyelectrolyte component of the treatment combination of the present invention may be organic in nature, such as an epichlorohydrin-dimethylamine (EPI-DMA) condensate polymer, an EPI-DMA-ethylenediamine (EDA) condensation polymer, diallyidimethylammonium chloride (poly DADMAC) a polyethylene-imine, or a polyamidoamine-based material. It may also be inorganic in nature such alum, polyaluminum chloride or other aluminum-based compounds.

The high molecular weight, anionic acrylamide of the present invention is preferably an essentially linear acrylamide/sodium acrylate copolymer. Other anionic acrylamide copolymers such as 2-acrylamido-2-methyl propane sulfonic acid (AMPS, a registered trademark of Lubrizol) would also be effective. By high molecular weight we referred to molecular weights preferably above 1,000,000 and most preferably above about 10,000,000. The mole percent anionic charge of the anionic acrylamide component can range from about 20 to 70% with a 30 mole percent negative charge material found to be particularly effective.

The present invention will now be further described with reference to a number of specific examples, which are to be regarded solely as illustrative and not as restricting the scope of the present invention.

EXAMPLES

The data in the following examples was generated using a laboratory drainage device using a laboratory prepared 75% stone ground wood/25% bleached soft wood kraft furnish. The drainage device drains stock through a 40 mesh wire while under the influence of vacuum. The vacuum reservoir set point remains constant throughout the test, but the level of vacuum under the wire changes as a function of drainage rate, the air flow resistance of the wire, and the air flow resistance of the forming pad. Simultaneously, a rotating foil underneath the wire provides pressure pulses to the forming sheet. Drainage rate and vacuum level data are collected during a drainage process which typically lasts only a few seconds. The target retained basis weight on the wire is that of an on machine application (for newsprint 48 grams per square meter). The amount of fibers required to meet the basis weight target is contained in a 250 gram dilute stock sample. When drainage has been completed, the vacuum continues to be applied to the formed pad for a fixed period of time. This allows an equilibrium vacuum level to be determined.

Three response variables were used to evaluate the effectiveness of the treatments tested. The corrected drainage time (CDT) based upon the elapsed time between the start of the test and the point where 90% of drainage has occurred (where 225 grams of filtrate has passed through the wire). A linear correction is used to adjust the raw drainage time for differences between the actual OD pad mass and the target. The first pass fines retention (FPFR) was based upon the OD mass of the retained pad and the original stock dry mass and fines content and is calculated in a conventional fashion. The vacuum level in the cavity underneath the wire reaches a maximum just before the air/water interface breaks through the wire. The ratio of this maximum to the equilibrium vacuum has been defined as the peak to equilibrium vacuum ratio (PEVR). The PEVR has been shown to be related to the effects of chemical treatment on sheet formation. A low PEVR is indicative of better sheet formation. The data which the CDT and PEVR are based upon are generated via a high speed data acquisition system. Testing was done in five replicates per condition to increase the degree of data precision.

Example 1

In Table 1, the results of a treatment sequence of cationic starch/alum (a cationic polyelectrolyte)/anionic polyacrylamide with and without colloidal silica are summarized. In addition, the order of addition of cationic starch and alum were reversed. A comparison when alum was replaced by an EPI/DMA/EDA condensation polymer is also shown. In Table 1 the materials employed were as follows: a cold water soluble amphoteric potato starch with a cationic degree of substitution of 0.3 mole percent; ANPAM, a polyacrylamide having a 30 mole percent sodium acrylate/acrylamide ratio of high molecular weight. In Table 1 all dosages shown in parenthesis are stated in pounds per ton of actives. An untreated control and a conventional dual cationic treatment program of an EPI/DMA/EDA coagulant plus a cationic polyacrylamide were run for comparative purposes.

TABLE 1

| Treatment | CDT (Sec.) | FPFR % | PEVR |
|---|---|---|---|
| Starch (20)/Alum (5)/ ANPAM (0.5)/Colloidal Silica (2) | 2.46 | 17.19 | 1.49 |
| Starch (20)/Alum (5)/ ANPAM (0.5) | 2.52 | 17.96 | 1.50 |
| Alum (5)/starch (20)/ ANPAM (0.5) | 2.49 | 23.66 | 1.42 |
| Starch (20)/EPI/DMA/EDA (0.5)/ANPAM (0.5) | 2.48 | 18.35 | 1.47 |
| Untreated Control | 3.00 | −5.25 | 1.88 |

The data in Table 1 shows that removing colloidal silica from a cationic starch/cationic polyelectrolyte/anionic high molecular weight polyacrylamide treatment shows no significant difference in drainage time, fines retention and PEVR. This was surprising due to prior art teachings that colloidal silica or other micro particle material is essential in such treatments, and that anionic polyacrylamides are not favored as newsprint retention aids. The data also shows that an organic polyelectrolyte can be substituted for alum without significantly effecting the results, but may be used at only 10% of the alum dosage. In Table 1, the negative value for FPFR untreated control is a result of the relatively coarse wire as compared to screens used for traditional stock fines fractionation. This means that stock retention on the wire during this test series is more difficult than any Britt fines fractionation jar.

Example 2

In Table 2, the testing, as summarized in Table 1, was repeated on a second, separately prepared batch of furnish. In addition, independent testing of starch, ANPAM, and alum were run.

TABLE 2

| Treatment | CDT (Sec.) | FPFR % | PEVR |
|---|---|---|---|
| Starch (20)/Alum (5)/ ANPAM (0.5)/Colloidal Silica (1) | 3.06 | 22.99 | 1.10 |
| Starch (20)/Alum (5)/ ANPAM (0.5) | 3.05 | 24.26 | 1.11 |
| Alum (5)/Starch (20)/ ANPAM (0.5) | 3.18 | 22.29 | 1.09 |
| Starch (20)/EPI/DMA/EDA (0.5)/ANPAM (0.5) | 3.18 | 22.80 | 1.15 |
| Starch (20)/ANPAM (0.5) | 3.63 | 15.22 | 1.20 |
| EPI/DMA/EDA (0.5)/ANPAM (0.5) | 3.77 | 13.38 | 1.15 |
| Starch (20) | 3.60 | 13.00 | 1.09 |
| Alum (5) | 4.34 | 2.05 | 1.19 |
| ANPAM (0.5) | 4.77 | 0.84 | 1.28 |
| Untreated Control | 5.43 | −0.90 | 1.34 |

Example 3

In Table 3 testing to evaluate the effects of cationic starch dosage was undertaken. The data shows that while the formation indicators remain relatively constant, there was a marked sensitivity to starch dosage in the drainage and retention responses.

TABLE 3

| Treatment | CDT (Sec.) | FPFR % | PEVR |
|---|---|---|---|
| Starch (20)/EPI/DMA/EDA (0.5)/ANPAM (0.5) | 3.18 | 22.80 | 1.15 |
| EPI/DMA/EDA (0.5)/Starch (20)/ANPAM (0.5) | 3.22 | 22.89 | 1.14 |
| Starch (10)/EPI/DMA/EDA (0.5/ANPAM (0.5) | 3.26 | 18.57 | 1.13 |
| EPI/DMA/EDA (0.5)/Starch (10)/ANPAM (0.5) | 3.44 | 18.18 | 1.15 |
| Starch (5)/EPI/DMA/EDA (0.5)/ANPAM (0.5) | 3.38 | 16.84 | 1.15 |
| EPI/DMA/EDA (0.5)/Starch (5)/ANPAM (0.5) | 3.47 | 17.84 | 1.16 |
| Starch (0)/EPI/DMA/EDA (0.5)/ANPAM (0.5) | 3.77 | 13.38 | 1.15 |
| EPI/DMA/EDA (0.5)/Starch (0)/ANPAM (0.5) | 3.77 | 13.38 | 1.15 |

Example 4

In Table 4, the effects of cationic polyelectrolyte dosage on the combination of the present invention were studied.

TABLE 4

| Treatment | CDT (Sec.) | FPFR % | PEVR |
|---|---|---|---|
| Starch (20)/EPI/DMA/EDA (1.0)/ANPAM (0.5) | 3.03 | 23.54 | 1.10 |
| Starch (20)/EPI/DMA/EDA (0.75)/ANPAM (0.5) | 3.12 | 20.21 | 1.12 |
| Starch (20)/EPI/DMA/EDA (0.5)/ANPAM (0.5) | 3.18 | 22.80 | 1.15 |
| Starch (20)/EPI/DMA/EDA (0.25)/ANPAM (0.5) | 3.22 | 26.80 | 1.15 |
| Starch (20)/EPI/DMA/EDA (0)/ANPAM (0.5) | 3.63 | 15.22 | 1.20 |

Example 5

In Table 5, the effect of anionic, high molecular weight polyacrylamide dosage in the combination of the present invention and similar combinations, which include a colloidal silica, was tested.

TABLE 5

| Treatment | CDT (Sec.) | FPFR % | PEVR |
|---|---|---|---|
| Starch (20)/Alum (5)/ANPAM (0.75) | 3.02 | 26.42 | 1.18 |
| Starch (20)/Alum (5)/ANPAM (0.75)/Colloidal Silica (2) | 2.90 | 25.48 | 1.14 |
| Starch (20)/Alum (5)/ANPAM (0.5) | 3.05 | 24.26 | 1.11 |
| Starch (20)/Alum (5)/ANPAM (0.5)//Colloidal Silica (1) | 3.06 | 22.99 | 1.10 |
| Starch (20)/Alum (50)/ANPAM (0.25) | 3.22 | 19.24 | 1.09 |
| Starch (20)/Alum (5)/ANPAM (0.25)/Colloidal Silica (2) | 3.04 | 22.19 | 1.12 |

Example 6

In Table 6(B), a variety of anionic, high molecular weight polyacrylamide polymers was evaluated. All of this type of polymer tested were efficacious. Products having 20 to 40 mole percent anionic range were preferred with Treatment B being most preferred. Table 6(A) summarizes the properties of anionic polymers tested.

TABLE 6(A)

| Treatment | Form | Mole % AA | Relative Molecular Weight ($10^6$) |
|---|---|---|---|
| A | Powder | 20 | 11 |
| B | Emulsion | 30 | 21 |
| C | Powder | 30 | 12 |
| D | Emulsion | 30 | 21 |
| E | Powder | 30 | 18 |
| F | Emulsion | 40 | 23 |
| G | Powder | 40 | 18 |
| H | Powder | 70 | 15 |
| I | Powder | 100 | 6 |

TABLE 6(B)

| Treatment | CDT (Sec.) | FPFR % | PEVR |
|---|---|---|---|
| Starch (20)/EPI/DMA/EDA (0.5)/A (0.5) | 3.26 | 19.22 | 1.16 |
| Starch (20)/EPI/DMA/EDA (0.5)/B (0.5) | 3.03 | 23.54 | 1.10 |
| Starch (20)/EPI/DMA/EDA (0.5)/C (0.5) | 3.27 | 15.32 | 1.14 |
| Starch (20)/EPI/DMA/EDA (0.5)/D (0.5) | 3.31 | 18.23 | 1.20 |
| Starch (20)/EPI/DMA/EDA (0.5)/E (0.5) | 3.23 | 19.61 | 1.16 |
| Starch (20)/EPI/DMA/EDA (0.5)/F (0.5) | 3.17 | 23.48 | 1.12 |
| Starch (20)/EPI/DMA/EDA (0.5)/G (0.5) | 3.34 | 17.76 | 1.14 |
| Starch (20)/EPI/DMA/EDA (0.5)/H (0.5) | 3.37 | 13.24 | 1.19 |
| Starch (20)/EPI/DMA/EDA (0.5)/I (0.5) | 3.44 | 9.66 | 1.22 |

Example 7

In Table 7(B), the effect of various organic cationic polyelectrolyte materials in the combination of the present invention was tested. All of the tested materials were efficacious. Table 7(A) summarizes the properties of the organic cationic polyelectrolytes tested.

TABLE 7(A)

| Treatment | Description |
|---|---|
| J | Branched EPI/DMA/EDA condensate |
| K | Linear EPI/DMA condensate - lower molecular weight |
| L | Linear EPI/DMA condensate - higher molecular weight |
| M | Poly diallyldimethylammonium dichloride (DADMAC) - lower molecular weight |
| N | Poly diallyldimethylammonium chloride - higher molecular weight |
| O | Polyamidopolyamine epichlorohydrin condensate |
| P | Polyethyleneimine |

TABLE 7(B)

| Treatment | CDT (Sec.) | FPFR % | PEVR |
|---|---|---|---|
| Starch (5)/J (0.5)/ANPAM (0.5) | 3.04 | 10.97 | 1.18 |
| Starch (5)/K (0.5)/ANPAM (0.5) | 3.25 | 10.79 | 1.23 |
| Starch (5)/L (0.5)/ANPAM (0.5) | 3.21 | 9.46 | 1.25 |

TABLE 7(B)-continued

| Treatment | CDT (Sec.) | FPFR % | PEVR |
|---|---|---|---|
| Starch (5)/M (0.5)/ANPAM (0.5) | 3.15 | 13.58 | 1.22 |
| Starch (5)/N (0.5)/ANPAM (0.5) | 3.16 | 14.57 | 1.27 |
| Starch (5)/O (0.5)/ANPAM (0.5) | 3.40 | 9.35 | 1.28 |
| Starch (5)/P (0.5)/ANPAM (0.5) | 3.05 | 22.33 | 1.24 |

Example 8

In Table 8(B), the efficacy of various modified starches in the combination of the present invention was tested. All of the starches tested were efficacious. In general, the more highly substituted starches were preferred. Table 8(A) summarizes the properties of commercially available starches tested.

TABLE 8(A)

| Treat-ment | Source | Degree of Cationic Substit. (Mole %) | Ionic Function | Degree of Anionic Substit. (Mole %) | Ionic Function |
|---|---|---|---|---|---|
| Q | Potato-Cold Water Soluble | 0.30 | Quat. Amine | unknown | phosphate |
| R | Dent Corn | 0.20 | Quat. Amine | 0 | |
| S | Dent Corn | 0.28 | Quat. Amine | 0 | |
| T | Dent Corn | 0.35 | Quat. Amine | 0 | |
| U | Waxy Maize | 0.18 | Quat. Amine | 0 | |
| V | Waxy Maize | 0.28 | Quat. Amine | 0 | |
| W | Waxy Maize | 0.35 | Quat. Amine | 0 | |
| X | Potato | 0.18 | Quat. Amine | 0.3 | phosphate |
| Y | Potato | 0.28 | Quat. Amine | 0.3 | phosphate |
| Z | Potato | 0.35 | Quat. Amine | 0.3 | phosphate |

TABLE 8(B)

| Treatment | CDT (Sec.) | FPFR % | PEVR |
|---|---|---|---|
| Q (10)/J (0.5)/ANPAM (0.5) | 3.03 | 17.71 | 1.25 |
| R (10)/J (0.5)/ANPAM (0.5) | 3.00 | 20.82 | 1.24 |
| S (10)/J (0.5)/ANPAM (0.5) | 3.02 | 16.49 | 1.32 |
| T (10)/J (0.5)/ANPAM (0.5) | 2.96 | 21.39 | 1.22 |
| U (10)/J (0.5)/ANPAM (0.5) | 2.97 | 17.58 | 1.24 |
| V (10)/J (0.5)/ANPAM (0.5) | 3.08 | 17.41 | 1.23 |
| W (10)/J (0.5)/ANPAM (0.5) | 2.94 | 22.87 | 1.22 |
| X (10)/J (0.5)/ANPAM (0.5) | 3.05 | 14.13 | 1.25 |

TABLE 8(B)-continued

| Treatment | CDT (Sec.) | FPFR % | PEVR |
|---|---|---|---|
| Y (10)/J (0.5)/ANPAM (0.5) | 3.02 | 17.44 | 1.25 |
| Z (10)/J (0.5)/ANPAM (0.5) | 2.94 | 22.64 | 1.22 |

What is claimed is:

1. A process to improve the drainage rate and retention of fines during papermaking with a mechanical pulp-based furnish substantially free of fillers in a papermaking process substantially free of silica and/or bentonite while maintaining sheet formation properties comprising the steps of:

A. adding to an aqueous paper furnish containing pulp, sequentially or in combination:
   (i) from about 1 to about 50 lbs/ton of a cationic or amphoteric starch; and
   (ii) either about 0.1 to about 10 lbs/ton of a cationic organic polyelectrolyte or from about 2.5 to about 10 lbs/ton of a cationic inorganic polyelectrolyte; and thereafter B. adding to said aqueous paper furnish containing pulp and said cationic or amphoteric starch and said cationic polyelectrolyte, from about 0.25 to about 0.75 lbs/ton of a high molecular weight anionic acrylamide copolymer, wherein the molecular weight of said anionic acrylamide copolymer is greater than about 10,000,000;

wherein in said process no fillers are added to the mechanical pulp-based furnish.

2. The process of claim 1 wherein said cationic or amphoteric starch is selected from the group consisting of potato starch, dent corn starch, and waxy maize starch.

3. The process of claim 2 wherein said starch has a degree of quaternary ammonium substitution between about 0.1 and 0.4%.

4. The process of claim 1 wherein said cationic polyelectrolyte is selected from the group consisting of epichlorohydrin-dimethylamine condensation polymers, epichlorohydrin-dimethylamine-ethylene diamine condensation polymers, diallyidimethylammonium chloride, polyethyleneimines, polyamidoamines, alum, and polyaluminum chloride.

5. The process of claim 1 wherein said acrylamide copolymer is an essentially linear acrylamide/sodium acrylate copolymer.

6. The process of claim 1 wherein said acrylamide copolymer is an essentially linear acrylamide/2-acrylamide-2-methyl propane sulfonic acid.

7. The process of claim 1 wherein the mole percent anionic charge of said acrylamide copolymer ranges from about 20% to about 70%.

* * * * *

UNITED STATES PATENT AND TRADEMARK OFFICE

CERTIFICATE OF CORRECTION

PATENT NO. : 6,168,686 B1 
DATED : January 2, 2001
INVENTOR(S) : Frank J. Sutman and Richard A. Hobirk It is certified that error appears in the above-identified patent and that said Letters Patent is hereby corrected as shown below:

Column 2,
Line 1, please delete "silicalbentonite-type" and insert -- silical/bentonite-type -- therefor.
Line 60, please delete "diallyidimethylammonium" and insert -- diallyldimethylammonium -- therefor.

Signed and Sealed this

Eighteenth Day of January, 2005

JON W. DUDAS
*Director of the United States Patent and Trademark Office*